United States Patent [19]

Miki et al.

[11] 4,334,575

[45] Jun. 15, 1982

[54] METHOD FOR COOLING A PLUNGER TIP IN A DIE CASTING MACHINE OF THE COLD CHAMBER TYPE AND APPARATUS THEREFOR

[75] Inventors: Isao Miki; Tsutomu Nagi, both of Shimizu, Japan

[73] Assignee: Nippon Light Metal Co., Ltd., Tokyo, Japan

[21] Appl. No.: 131,553

[22] Filed: Mar. 18, 1980

[51] Int. Cl.[3] ..... B22D 17/20

[52] U.S. Cl. ..... 164/113; 164/157; 164/312; 165/71

[58] Field of Search ..... 164/113, 312-315, 164/157; 165/71

[56] References Cited

U.S. PATENT DOCUMENTS

| | | | |
|---|---|---|---|
| 3,074,131 | 1/1963 | Wernecke | 164/314 |
| 3,885,620 | 5/1975 | Von Cleve | 165/71 X |
| 4,154,288 | 5/1979 | Borgen | 164/312 X |

*Primary Examiner*—Robert D. Baldwin
*Assistant Examiner*—J. Reed Batten, Jr.
*Attorney, Agent, or Firm*—Oblon, Fisher, Spivak, McClelland & Maier

[57] ABSTRACT

The method for cooling a plunger tip in a die casting machine of the cold chamber type comprises forcibly cooling the inner hollow space in the plunger tip by applying a flow of cooling fluid into and out of the inner hollow space during the time from about the commencement of the injection of the molten metal into the cavity of the moulds of the die casting machine by the forward stroke of the plunger to the commencement of the return stroke of the plunger, and applying, after terminating the application of the cooling fluid to the inner hollow space of the plunger tip, a flow of pressurized gas into and out of the inner hollow space of the plunger tip during the time at least necessary for expelling the remaining cooling fluid from the inner hollow space of the plunger tip so as to prevent excessive cooling and permit the plunger tip to be subjected to uniform natural cooling by the pressurized gas. The device for carrying out the above described cooling of the plunger tip comprises a cooling fluid source and a pressurized gas source, and control means for alternately supplying cooling fluid from the source of the cooling fluid for a predetermined time period and pressurized gas from the source of the pressurized gas for a predetermined time period into the inner hollow space of the plunger tip in timed relationship to the actuation of the stroke of the plunger tip for effecting the die casting cycle of operation.

14 Claims, 1 Drawing Figure

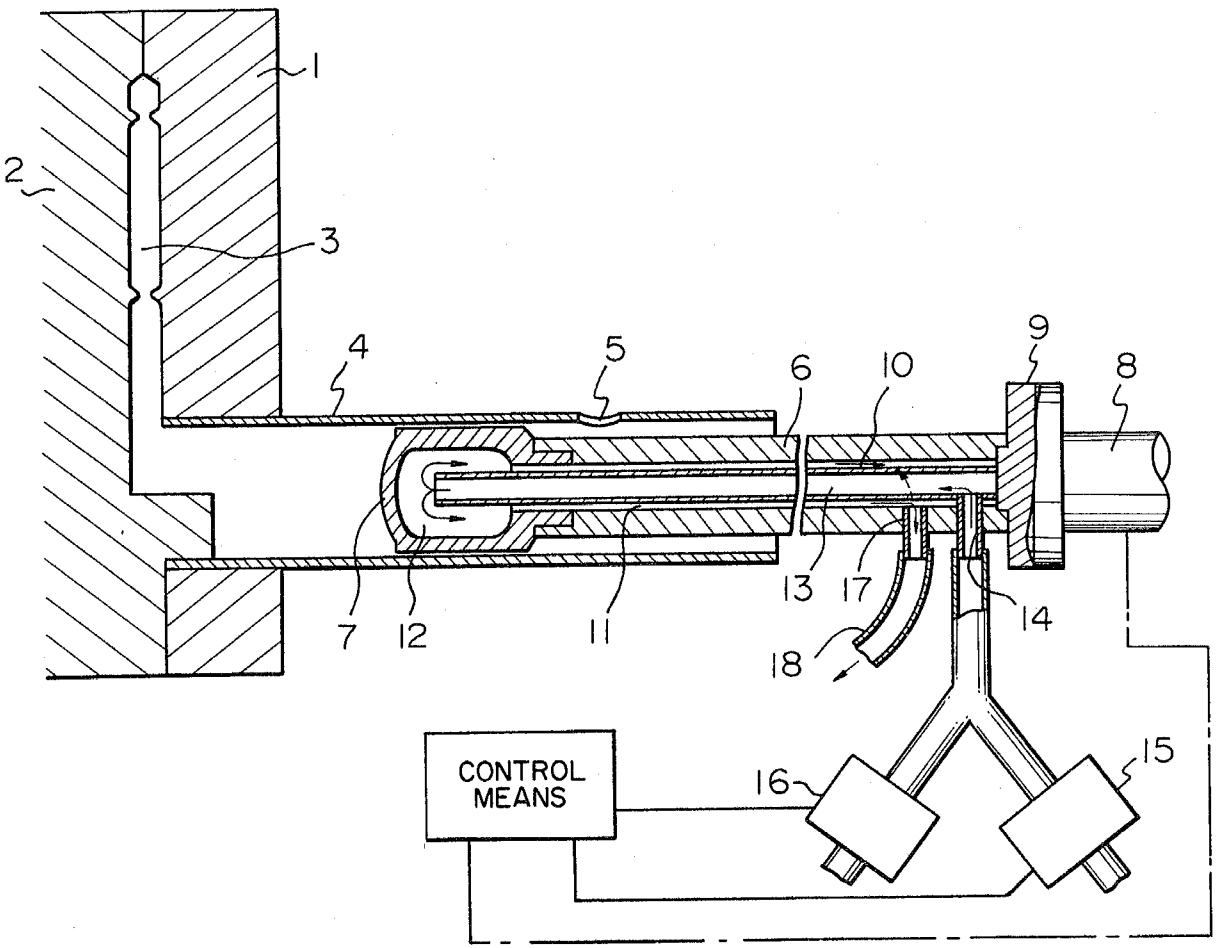
CONTROL MEANS
1
2
3
4
5
6
7
8
9
10
11
12
13
14
15
16
17
18

METHOD FOR COOLING A PLUNGER TIP IN A DIE CASTING MACHINE OF THE COLD CHAMBER TYPE AND APPARATUS THEREFOR

BACKGROUND OF THE INVENTION

The present invention relates to a method for cooling a plunger tip in a die casting machine of the cold chamber type and an apparatus for carrying out the method. More particularly, it relates to a method for cooling a plunger tip in a die casting machine in order to minimize generation of casting fins formed between the outer peripheral surface of the plunger tip and the inner peripheral surface of the injection sleeve in which the plunger is reciprocally removed for effecting the injection die casting process and an apparatus for carrying out the method.

It has been widely developed to utilize a die casting machine of the cold chamber type in order to carry out injection moulding of die cast products from a molten metal such as aluminum. In such a die casting machine of the cold chamber type, a plunger is provided which is reciprocally moved within an injection sleeve and the molten metal supplied into the sleeve is propelled into a die cavity by the operation of the plunger so as to form die cast products in the die cavity. Since the plunger tip attached to the forward end of the plunger for urging the molten metal into the die cavity directly contacts with the molten metal of a very high temperature and is heated to the high temperature so that the plunger tip is subjected to thermal expansion, a relatively large clearance must be provided between the inner surface of the injection sleeve and the outer surface of the plunger tip. In case of aluminum die casting process, a clearance of about 0.1–0.4 mm is usually given in diameter between the injection sleeve and the plunger tip, for example.

On the other hand, the velocity of the plunger tip during the injection moulding operation is rather high in the order of about 0.3–4 m/sec. while a high pressure of about 100–1000 kg/cm$^2$ is required for effecting injection moulding of aluminum, for example.

Therefore, it is impossible to avoid generation of casting fins formed by the molten metal entering the clearance between the sleeve and the tip during the injection moulding operation.

Further, in case of a die casting machine of the horizontal cold chamber type, for example, since the duration of time in which the lower portion of the plunger tip contacts with the molten metal during each cycle of the die casting operation is longer than the contacting time of the upper portion of the tip with the molten metal, temperature difference necessarily occurs between the upper and the lower portion of the tip thereby resulting in greater thermal expansion in the lower portion of the tip than in the upper portion. Therefore, as the number of cycles of the die casting operation increases, a certain steady temperature difference is maintained between the upper and the lower portion of the tip resulting in the steady greater thermal expansion in the lower portion of the tip. This tends to generate more casting fins in the upper portion of the tip because of the smaller thermal expansion at that portion thereby rendering localized greater wear to occur at the upper portion of the tip.

When such casting fins are formed, seizure or sticking will take place between the sleeve and the tip due to melting of portions of the metal forming them, thus expediting wear in the sleeve and the tip while the quality of the die cast products is deteriorated because of the false function of the plunger tip by the wear and the seizure to the sleeve.

The above described difficulties become more serious in case of oxygen die casting process, vacuum die casting process, laminate flow die casting process or the like in which the quantity of lubricant used in the process is limited.

Therefore, the early solution of the above described problem is eagerly desired.

To this end, it has been proposed to form the plunger tip from a metallic material having smaller thermal expansion coefficient while the clearance between the injection sleeve and the plunger tip is made as small as possible and a hollow space is formed within the tip in which cooling water is circulated at all times the die casting machine is being operated so that the thermal influence given to the tip is alleviated.

In such a method, however, cooling water flows through the inner hollow space in the tip at all times during the operation of the die casting machine, and, therefore, the general temperature of the tip is lowered thereby making it impossible to effectively utilize the thermal expansion of the tip for reducing the clearance between the sleeve and the tip so as to minimize formation of the casting fins. Thus, the stability in the operation of the die casting machine is deteriorated due to the increase in generation of the casting fins.

In order to avoid the above described difficulties, it has been proposed to circulate cooling water in the inner hollow space of the plunger tip only in the predetermined time during each cycle of operation of the die casting machine. However, definite defficiency has been found in such a measure that localized excessive wear can not be avoided due to difference in the thermal expansion between the upper and the lower portion of the tip in the case of the horizontal cold chamber type die casting machine even though the supply of the cooling water is stopped in an appropriate time during each cycle of operation of the die casting machine, because the lower portion of the tip is continuingly cooled by the cooling water remaining in the hollow space of the tip after the supply of the cooling water is stopped to thereby result in the temperature difference between the upper and the lower portion of the tip causing the localized wear in the tip.

Also, in case of a die casting machine of the upright cold chamber type, excessive cooling effect on the plunger tip tends to occur because of the cooling water remaining in the hollow space in the tip after stopping the supply of the cooling water, although the temperature of the tip is maintained substantially uniform in the tip in comparison with the case of the die casting machine of the horizontal cold chamber type. Thus, satisfactory results can not be obtained in the die casting machine of the upright die casting machine.

The present invention aims at avoiding the above described disadvantages of the prior art die casting machine of the cold chamber type.

SUMMARY OF THE INVENTION

It is the primary object of the present invention to provide a method for cooling a plunger tip in a die casting machine of the cold chamber type which avoids the above described disadvantages of the prior art die casting machine.

Another object is to provide a method of the type described above which permits generation of casting fins to be reduced to the minimum in order to achieve efficient and satisfactory operation of the die casting machine of the cold chamber type.

A further object is to provide an apparatus for carrying out the above described method of the present invention.

In accordance with the present invention, a novel method for appropriately cooling a die casting plunger tip is provided which comprises cooling the tip, which has been heated to a high temperature by the contact with the molten metal, by forcibly flowing through the interior of the tip a cooling fluid for a certain predetermined time period, and, after terminating the above described forced cooling, discharging the cooling fluid remaining in the interior of the tip as soon as possible by flowing pressurized gas through the interior of the tip, thereby insuring inadequate localized cooling or excessive cooling to be positively prevented, while uniform natural cooling is given to the tip by the pressurized gas.

By virtue of the above described method of the present invention, appropriate uniform cooling of the plunger tip is insured, while inadequate localized or excessive cooling of the tip is prevented so that uniform thermal expansion of the tip is achieved through the time of the die casting operation thereby permitting the clearance between the sleeve and the tip to be made to the minimum to obviate generation of the casting fins, seizure of the tip to the sleeve, and scratching or sticking of the sleeve by the casting fins during the stroke of the tip and achieving stable die casting operation.

The time period of the above described forced cooling of the tip by the medium of the cooling fluid and the setting of the degree of the cooling of the tip depend upon the conditions of the lubricant used and the die casting operation and vary variously. For example, it is preferable to effect the forced cooling during the time from the commencement of the injection moulding operation to the commencement of the return stroke of the plunger. Further, it is preferred that the temperature of the tip at the commencement of the injection moulding will not descend below the temperature at the return stroke of the plunger.

Further, since the temperature of the tip continues to descend by the natural cooling by air after the cooling fluid has been expelled from the interior of the tip, it is necessary to determine the cooling conditions of the tip by the cooling fluid and to determine the timing of supply of the cooling fluid and the termination thereof with the above described natural cooling of the tip by air being taken into consideration.

In the aluminum extruding process, for example, it is preferable to lower the temperature of the tip by about 50°-300° C., preferably by about 50°-200° C. When the temperature of the tip is lowered by about 300° C. or more by the forced cooling, excessive cooling of the tip will result after the natural cooling is effected by air, such being undesirous. On the other hand, the temperature drop in the tip less than by about 50° C. by the forced cooling will result in insufficient shrinkage of the tip thereby rendering seizure or sticking of the tip to the sleeve to occur, so that excessive quantity of the lubricant must be applied to the tip due to the too high temperature of the tip which is not desirous.

Further, since the detailed cooling conditions for cooling the tip vary depending upon the temperature of the molten metal, the cycle time of the die casting condition, the material forming the tip, and the configuration of the tip per se, etc., appropriate cooling cycle should be set in consideration of the above.

Apart from the above, the plunger tip is subjected to various complicated stresses such as tensional stress, compressive stress and shearing stress occurring in complicated combination thereof during the die casting operation. Consequently, the amounts of strains in various portions of the tip differ variously.

BRIEF DESCRIPTION OF THE DRAWING

The accompanying drawing is a cross-sectional view showing an embodiment of the die casting machine of the horizontal cold chamber type constructed in accordance with the present invention.

DETAILED DESCRIPTION OF THE PREFERRED EMBODIMENTS

In the FIGURE, the die casting machine of the horizontal cold chamber type comprises a stationary metallic mould 1 and a movable metallic mould 2 between which a die cavity 3 is formed when the both moulds 1, 2 are moved toward each other and closed together and an injection sleeve 4 attached to the stationary mould 1 and having a pouring gate 5 near the free end thereof. A plunger 6 having a tip 7 attached to the forward end thereof is slidably received in the sleeve 4 and reciprocally driven therein by a piston rod 8 of a driving device (not shown) through a coupling 9 connecting the same to the rear end of the plunger 6.

Molten metal is supplied into the sleeve 4 through the pouring gate 5 when the tip 7 is retracted beyond the pouring gate 5 and is injected into the cavity 3 for forming a die cast product by the forward movement of the tip 7 driven by the driving device.

The plunger 6 is in the form of a hollow cylinder, in which a pipe 10 is arranged, and the rear end of the pipe 10 is securely attached to the coupling 9 so that an annular passage 11 is held between the inner surface of the plunger 6 and the outer surface of the pipe 10. The forward open end of the pipe 10 is terminated within a hollow space 12 formed in the tip 7.

The inner passage 13 formed in the pipe 10 communicates with an inlet pipe 14 secured to the pipe 10 adjacent to the coupling 9, which inlet pipe 14 sealingly passes through the plunger 6 and is connected to both of a valve 15 for supplying cooling fluid or liquid such as water from a source (not shown) when opened and a valve 16 for supplying pressurized gas such as pressurized air from a source (not shown) when it is switchingly opened while the valve 15 is held closed by operation of the control means. The valves 15 and 16 may be controlled in timed relationship with the actuation of the sleeve 6.

On the other hand, an outlet pipe 17 is attached to the plunger 6 near the coupling 9 and communicates with the annular passage 11 between the plunger 6 and the pipe 10.

Thus, the cooling fluid or the pressurized gas supplied into the inner passage 13 through the inlet pipe 14 is introduced into the hollow space 12 and is discharged through the annular passage 11 and the outlet pipe 17 to the exterior of the die casting machine through a discharge pipe 18 to an appropriate location as shown by arrows.

In operation of the die casting machine, the moulds 1 and 2 are closed tightly together and a predetermined quantity of molten metal is poured into the sleeve 4 through the pouring gate 5 after the tip 7 is retracted beyond the gate 5, and then the tip 7 is moved forwardly by a predetermined force so as to inject the molten metal into the die cavity 3 and the tip 7 is held to continuingly apply the predetermined pressure to the molten metal for a predetermined time such as about 5 seconds after commencement of the injection of the molten metal. After the die cast product and the moulds 1, 2 are cooled to an appropriate temperature (about 25 seconds after commencement of the injection of the molten metal), the movable mould 2 is moved apart from the stationary mould 1, and, at substantially the same time, the tip 7 is further moved forwardly to the limit of its forward stroke so as to remove the residual solidified metal formed adjacent to the inlet portion of the cavity 3 and then the tip 7 is retracted to the limit of its rearward stroke.

Then, the cleaning operation of the moulds 1, 2 and the tip 7 as well as the application of lubricant is effected for the next die casting operation thereby terminating one cycle of operation. The period of one cycle of the die casting operation is about 20–120 seconds and the average temperature of the injection plunger 6 is about 150°–200° C.

In accordance with the characteristic feature of the present invention, the cooling of the tip 7 is commenced in synchronized timing relation with the injection moulding operation effected by the actuation of the plunger 6. In this case, the supply of the cooling fluid by the actuation of the valve 15 while the valve 16 is held closed is so controlled that the valve 15 is held opened for the time period from the commencement of the injection of the molten metal to the commencement of the return stroke of the plunger 6, preferably for the time period from the termination of maintenance of pressurization of the molten metal in the cavity 3 by means of the tip 7 forced against the molten metal, to the commencement of opening of the moulds 1 and 2 so as to supply the cooling fluid through the pipe 14, the inner passage 13 into the hollow space 12 in the tip 7 and discharge through the annular passage 11 and the pipe 17 to the discharge pipe 18 thereby cooling the plunger 6 and particularly cooling the tip 7. Simultaneously with or immediately after termination of the supply of the cooling fluid by closing the valve 15, the valve 16 is opened so as to supply the pressurized gas through the above described passages 14, 13 to the hollow space 12 in the tip 7 and discharge through the passages 11, 17 and 18 by the time until the return stroke of the plunger 6 commences, preferably by the time until the movable mould 2 reaches the limit of its opening stroke, thereby permitting the cooling fluid remaining in the hollow space 12 in the tip 7 to be substantially completely removed. As described previously, the valves 15, 16 are so controlled in timed relationship to the actuation of the plunger 6 that they are prevented from being opened simultaneously or either one of them is prevented from being opened while the other is held opened. The time period for keeping the valve 16 opened is set to as to permit the cooling fluid remaining in the hollow space 12 to be substantially completely removed therefrom.

In accordance with the present invention as described above, the tip 7 is uniformly cooled during the time until the molten metal in the cavity 3 solidifies and is held in the thermally expanded condition at the predetermined temperature as set by virtue of the above described control of the supply of the cooling fluid and the pressurized gas thereby permitting the clearance between the injection sleeve 4 and the tip 7 to be kept to the minimum. This makes it possible to prevent formation of casting fins in the clearance by the molten metal entering the clearance during the stroke of the plunger 6. Since the tip 7 is sufficiently cooled uniformly, generation of localized wear of the tip 7 and the sleeve 4 or seizure of the tip 7 to the sleeve 4 during the forward movement to the limit of its forward stroke and the return stroke is positively prevented. Further, since the forced cooling of the tip 7 by the cooling fluid is stopped during the return stroke of the plunger 6 and the tip 7 is subjected to uniform natural cooling by the medium of the pressurized gas after the cooling fluid in the hollow space 12 of the tip 7 is substantially removed by the pressurized gas, excessive cooling of the tip 7 is positively prevented, while application of the lubricant to the required parts of the die casting machine can be effected optionally, thereby permitting stable operation of the die casting machine to be insured.

The cooling fluid to be used in the forced cooling of the tip 7 may be cooling water of the room temperature up to about 25° C. or may be hot water of the temperature about 30°–90° C. depending upon the die casting conditions, such as the heat quantity given by the molten metal during each cycle of operation, the temperature to be set in the sleeve 4 for the optimum operation of the die casting machine. The hot water is used in case so much cooling effect is not required, and the temperature of the hot water is selected for the optimum operation.

On the other hand, the pressurized gas may be either of air or nitrogen.

An example of the test data according to the present invention will be described.

EXAMPLE 1

The aluminum die casting machine of the horizontal cold chamber type used was provided with a tip 7 having the outer diameter of 73 mm, the total length of 70 mm, the radial wall thickness of 13 mm, the top wall thickness of 12 mm and made of SKD-61 material, and air injection sleeve having the inner diameter of 73.20 mm. Solid lubricant was used as the lubricant during the operation of the machine. The die casting operation was carried out in oxygen substituted die casting process wherein molten metal of aluminum alloy ADC 12 held at the temperature of 650° C. was injected into the moulds at the casting pressure of 500 kg/cm$^2$ and in the die casting cycle of 65 seconds per one shot, while the moulds are opened in 15 seconds after the commencement of the injection. The cooling water was supplied to the hollow space in the tip during the time period of 5–15 seconds after the commencement of the injection (or the termination of application of dead head to the molten metal) and, immediately after termination of application of the cooling water, the pressurized air was supplied to the tip for 4 seconds so as to remove the remaining cooling water and to effect natural uniform cooling of the tip.

The results were shown in the following table:

| Supply of Cooling Water (Second) | Temperature of Tip at Commencement of Injection (°C.) | Temperature of Tip at Return Stroke of Plunger (°C.) Upper Portion | Lower Portion | Thickness of Casting Fin at Upper Portion of Tip (mm) | Size of Casting Fin (mm × mm) | Number of Cycles of Stable Operation (shot) |
|---|---|---|---|---|---|---|
| 5 | 192 | 254 | 254 | 0.1 | 5 × 5 | No seizure occured at 3000 shots |
| 10 | 132 | 212 | 224 | 0.20 | 20 × 20 | Seizure occurred at 500 shots |
| 15 | 104 | 184 | 208 | 0.25 | 50 × 50 | Seizure occurred at 30 shots |

As shown in the above table, it was proved in the above example that the time period for the forced cooling of the tip by the cooling water is preferably set to about 5 seconds in order to achieve optional results, and that, when the cooling time is made longer by continuously supplying the cooling water through the cycles as in the case of the prior art process, generation of casting fins will increase.

The above process of the present invention may also be applied to the die casting of zinc, magnesium, and the like to achieve good results.

It is also clear that the present invention may be applied to existing die casting machines of the cold chamber type by merely providing cooling fluid supply and pressurized gas supply together with the control system thereof.

We claim:

1. Method of cooling a plunger tip in a die casting machine of the cold chamber type including the steps of supplying a stream of cooling fluid to a hollow space formed in the tip for a predetermined time period, wherein the improvement comprises supplying said stream of cooling fluid in timed relationship to the actuation of the tip during the die casting operation so as to effect forced cooling of the tip, and completely purging all of said cooling fluid from said hollow space by supplying a stream of pressurized gas to the hollow space in the tip for a predetermined time period immediately after the termination of the supply of the stream of the cooling fluid in the hollow space in the tip so that said cooling fluid may uniformly cool the tip.

2. Method according to claim 1, wherein the forced cooling of the tip by the stream of the cooling fluid is effected during the time period from about the commencement of the injection of the molten metal into a mould of a die cast machine to about the removal of the die cast product from the mould by the forward stroke of the tip.

3. Method according to claim 1, wherein the forced cooling of the tip by the cooling fluid is effected during the time period from the completion of the injection of the molten metal to about the commencement of the return stroke of the tip.

4. Method according to claim 1, wherein the supply of the stream of the pressurized gas is effected for a time period sufficient to substantially remove all of the cooling fluid remaining in the hollow space in the tip after the termination of the supply of the stream of the cooling fluid thereto.

5. Method according to claim 1, wherein the cooling fluid is water while the pressurized gas is one from the group consisting of air and nitrogen.

6. Method according to claim 5, wherein the temperature of the cooling water is selected to be up to about 25° C.

7. Method according to claim 5, wherein the temperature of the cooling water is selected to be in the range of about 30° C. to about 90° C.

8. Apparatus for cooling a plunger tip in a die casting machine of the cold chamber type, including a hollow space formed in the tip, passage means formed in the plunger for introducing fluid into the hollow space in the tip and for discharging the same therefrom, a cooling fluid supplying source for supplying the cooling fluid to the hollow space in the tip through the passage means, wherein the improvement comprises a pressurized gas supplying source for supplying the pressurized gas to the hollow space in the tip through the passage means, and control means adapted for controlling the alternate supply of one of the cooling fluid and the pressurized gas from the respective supplying sources into the hollow space in the tip.

9. Apparatus according to claim 8, wherein said control means is adapted for control of the supply of the cooling fluid from the source to the tip or the supply of the pressurized gas from the source to the tip in timed relationship to the actuation of the tip.

10. Apparatus according to claim 8, wherein said control means is adapted for control of the supply of the cooling fluid from the source to the tip so that the cooling fluid is supplied for the time period from the commencement of the injection of the molten metal to the commencement of the return stroke of the tip.

11. Apparatus according to claim 8, wherein said control means is adapted for control of the supply of the cooling fluid from the source to the tip so that the cooling fluid is supplied for the time period from the termination of the application of pressurization of the molten metal in a mould of the die cast machine by the tip forced thereagainst to the commencement of the opening of the mould.

12. Apparatus according to claim 8, wherein the cooling fluid is water while the pressurized gas is one from the group consisting of air and nitrogen.

13. Apparatus according to claim 12, wherein the temperature of the cooling water is in the range of room temperature of up to about 25° C.

14. Apparatus according to claim 12, wherein the temperature of the cooling water is in the range of about 30° C. to about 90° C.

* * * * *